United States Patent [19]

Andis et al.

[11] Patent Number: 4,742,199

[45] Date of Patent: May 3, 1988

[54] HAND-HELD DRYER WITH WATERPROOF CHAMBER FOR ELECTRICAL SWITCH

[75] Inventors: Matthew L. Andis; Richard Urbush, both of Racine, Wis.

[73] Assignee: Outboard Marine Corporation, Waukegan, Ill.

[21] Appl. No.: 12,510

[22] Filed: Feb. 9, 1987

[51] Int. Cl.[4] ..... H01H 9/04

[52] U.S. Cl. ..... 200/302.1; 200/157

[58] Field of Search ..... 200/302.1, 331, 157

[56] References Cited

U.S. PATENT DOCUMENTS

| | | | |
|---|---|---|---|
| 1,869,646 | 8/1932 | Anderson | 200/302.1 |
| 4,105,882 | 8/1978 | Ulbing et al. | 200/157 |
| 4,342,894 | 8/1982 | Scott et al. | 200/302.1 |
| 4,395,608 | 7/1983 | Eicker et al. | 200/302.1 |
| 4,520,256 | 5/1985 | Doyle | 200/157 |

FOREIGN PATENT DOCUMENTS

| | | | |
|---|---|---|---|
| 2163294 | 2/1986 | United Kingdom | 200/302.1 |

*Primary Examiner*—Renee S. Luebke

*Attorney, Agent, or Firm*—Michael, Best & Friedrich

[57] ABSTRACT

A hand held electrically operated appliance, such as a hair dryer, a hair clipper, a hair blower, or the like, the appliance comprising a handle including first and second handle pieces including respective walls defining blind recesses located in opposing relation to each other, a resilient gasket disposed between the walls to define, with the recesses, a waterproof switch chamber including therein an electrical switch, the gasket affording water-tight passage into and from the chamber of an appropriate number of electrical leads, an actuator passing in water tight relation through the gasket into the chamber, being operably connected to the switch, and being manually movable by an operator so that movement of the actuator causes related movement of the switch between off and on positions, and a mechanism for fastening together the handle pieces to press the gasket between the walls to prevent entry of moisture into the chamber.

20 Claims, 2 Drawing Sheets

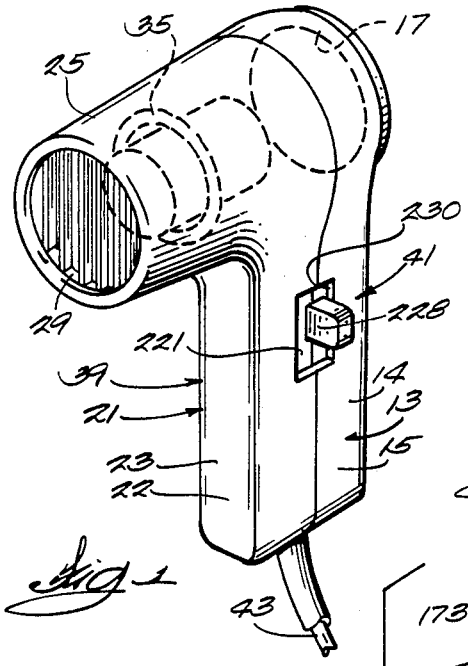
Fig. 1
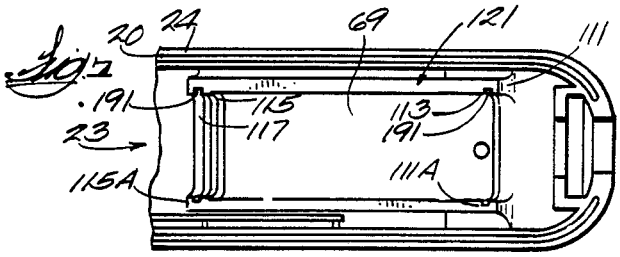
Fig. 7
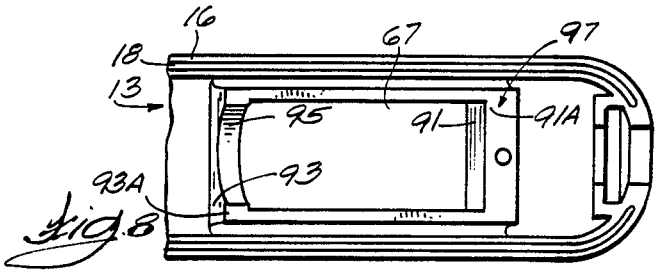
Fig. 8
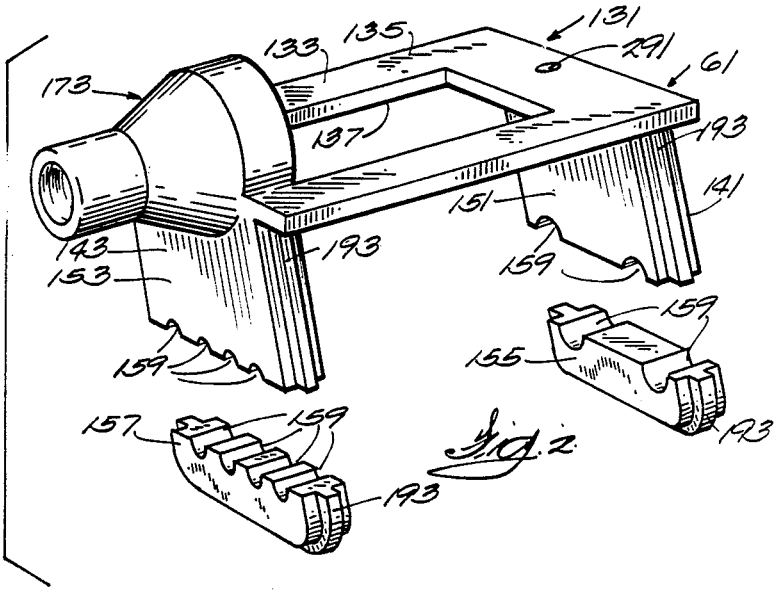
Fig. 2
Fig. 3
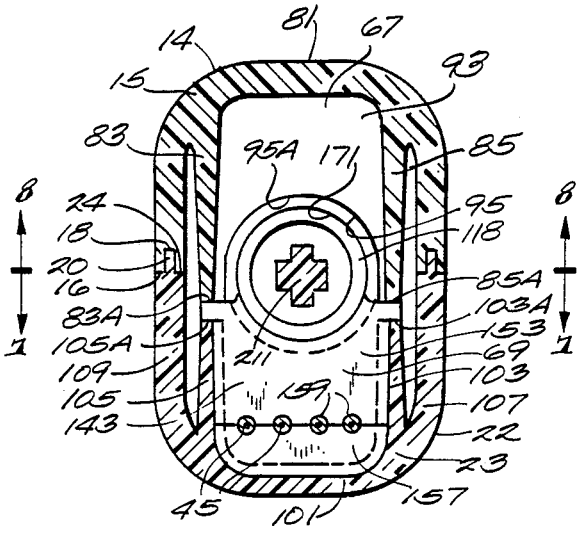
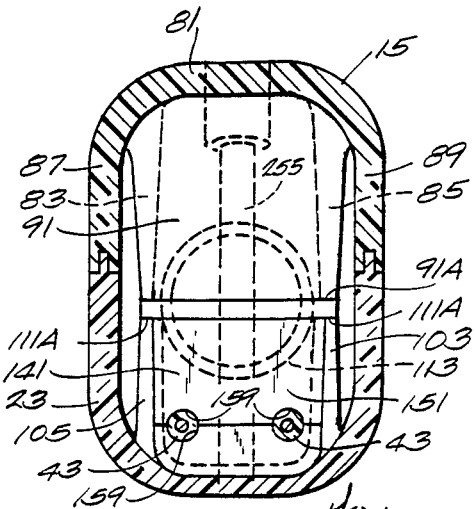
Fig. 4

HAND-HELD DRYER WITH WATERPROOF CHAMBER FOR ELECTRICAL SWITCH

BACKGROUND OF THE INVENTION

The invention relates to hand-held appliances, such as hair clippers, hair dryers, hair blowers, curling irons, or the like, and to the use of waterproof switches in such appliances to reduce the danger of electrocution in the event the appliance becomes wet.

Waterproof switches are relatively expensive to manufacture and it is important to avoid such expensive costs in the very competitive appliance market.

In one prior device, a sealed chamber was formed in a wall supported member to house a relatively inexpensive switch by providing a recess in the wall supporting member and by closing and sealing the recess with a gasket and a cover, which gasket admitted electrical leads and a movable actuator into the sealed recess to effect switch operation while maintaining water tight integrity.

As mentioned, this device was wall mounted and was not adapted to be hand-held. Such a device is shown in U.S. Pat. No. 4,659,907, filed Mar. 21, 1983, but there is no disclosure in this application of a switch located in a sealed recess.

OBJECT OF THE INVENTION

An object of the invention disclosed herein is to economically provide a hand-held appliance with a water proof or sealed chamber enclosing an inexpensive operating switch.

SUMMARY OF THE INVENTION

The invention provides a hand-held electrically operated appliance, such as a hair dryer, a hair clipper, a hair blower, a curling iron, or the like, which appliance comprises a handle including first and second handle pieces including respective wall means defining blind recesses located in opposing relation to each other, resilient gasket means disposed between the wall means to define, with the recesses, a waterproof switch chamber including therein an electrical switch, which gasket means includes means affording water-tight passage into and from the chamber of an appropriate number of electrical leads, actuator means passing in water-tight relation through the gasket into the chamber, being operably connected to the switch, and being manually movable by an operator so that movement of the actuator means causes related movement of the switch between off and on positions, and means for fastening together the handle pieces to press the gasket means between the wall means to prevent entry of moisture into the chamber.

The invention also provides an appliance comprising an elongated handle including first and second handle pieces constructed of water impervious and electrically insulating material and including respective first and second wall means defining blind recesses located in opposing and aligned relation to each other and having respective margins with respective end surfaces, resilient gasket means disposed between the first and second wall means and engaging the end surfaces to define, with the recesses, a waterproof switch chamber, which gasket means includes means affording water-tight passage into and from the chamber of an appropriate number of electrical leads, an electrical switch located in the chamber and connected to the electrical leads, an interior switch actuator located interiorly of the handle and passing in water-tight relation through the gasket means into the switch chamber and being movable in the direction of handle elongation, which interior switch actuator is operably connected to the switch, and an exterior actuator movably carried by the handle in spaced relation to the chamber and for movement in the direction of handle elongation, which exterior actuator is manually movable by an operator and is operably connected to the interior actuator so that movement of the exterior actuator causes related movement of the interior actuator to actuate the switch between off and on positions, and means for fastening together the handle pieces to press the gasket means between the first and second wall means to prevent entry of moisture into the chamber.

The invention also provides an appliance comprising an elongated handle including first and second handle pieces constructed of water impervious and electrically insulating material and including respective exterior surfaces, respective mating edge surfaces which respectively extend from the exterior surfaces and which respectively mate with each other, and respective first and second wall means defining blind recesses located in opposing and aligned relation to each other and having respective interior surfaces having respective margins with respective end surfaces located in spaced relation from and inwardly of the edge surfaces, resilient gasket means disposed between the first and second wall means and engaging the end surfaces to define, with the recesses, a waterproof switch chamber, which gasket means includes a gasket member having an endless portion with opposed surfaces respectively engaging the end surfaces of the handle pieces, spaced end wall portions extending transversely from the endless portion and engaging the end surfaces of the handle pieces, one of the end wall portions including a main portion and an end portion, and one of the end wall portions including a central opening, and an integrally extending hollow bellows portion movable relative thereto in the direction of handle elongation, an electrical switch in the chamber, electrical leads extending into the chamber between the main portion and the end portion of the one end wall and connected to the switch, an interior switch actuator located interiorly of the handle and passing in water-tight relation through the bellows portion of the gasket member into the chamber and being movable in the direction of handle elongation, which interior switch actuator is operably connected to the switch, an exterior actuator movably carried by the handle in spaced relation to the chamber and for movement in the direction of handle elongation, which exterior actuator is manually movable by an operator and is operably connected to the interior actuator so that movement of the exterior actuator causes related movement of the interior actuator to actuate the switch between off and on positions, means on the bellows portion and the interior actuator for sealing engagement therebetween, and means for fastening together the handle pieces to press the gasket member between the first and second wall means to prevent entry of moisture into the chamber.

Other objects, features and advantages of the invention will become known to those skilled in the art by reference to the following general description, the claims, and the appended drawings.

IN THE DRAWINGS

Fig. 1 is a perspective view of a hair blower or dryer incorporating various of the features of the invention;

Fig. 2 is a perspective view of a gasket member employed in the blower or dryer shown in FIG. 1;

Fig. 3 is a sectional view taken along line 3—3 of FIG. 6;

Fig. 4 is a sectional view taken along line 4—4 of FIG. 6;

Fig. 7 is a fragmentary sectional view taken along line 7—7 of FIG. 3, with parts omitted; and FIG. 8 is a fragmentary sectional view taken along line 8—8 of FIG. 3, with parts omitted.

Figure 5:
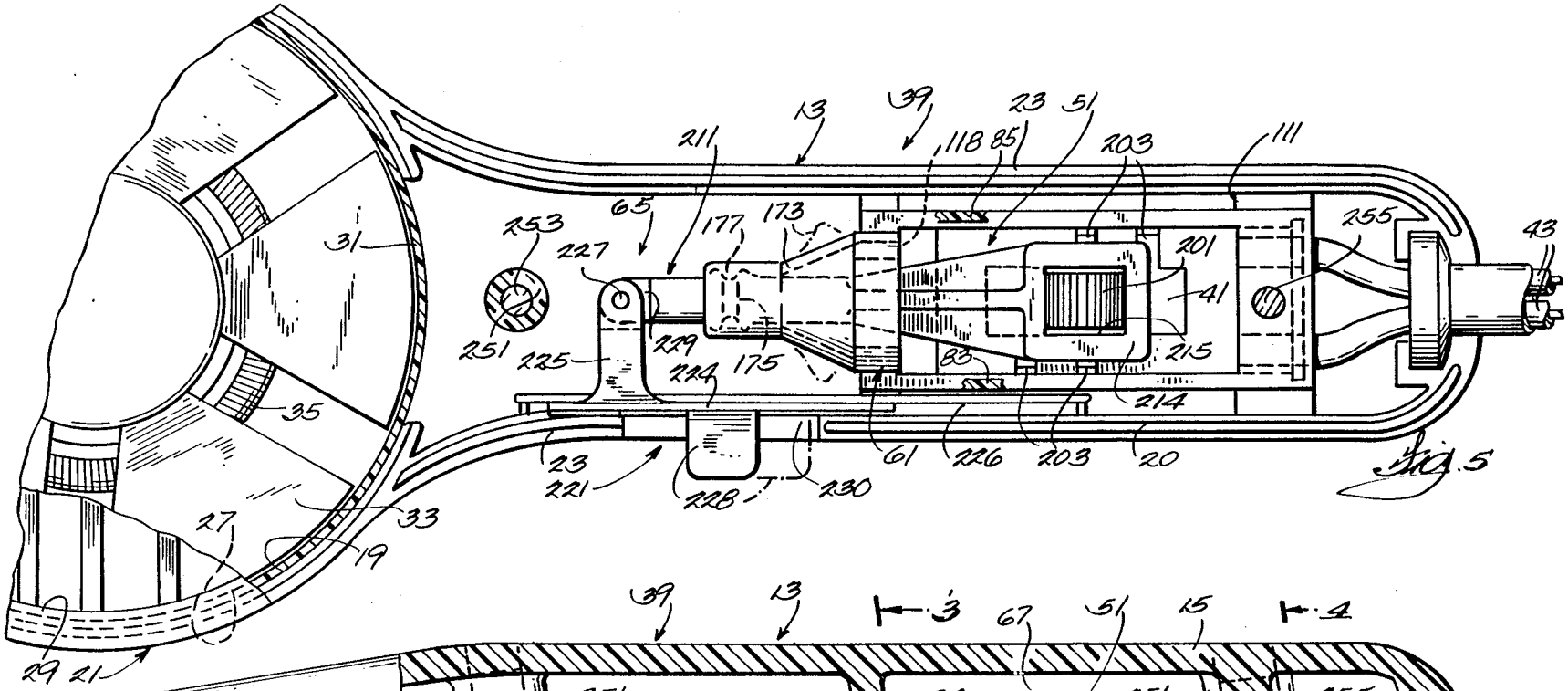
Fig. 5 is an enlarged sectional view of the handle incorporated in the hair blower or dryer shown in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a hand held hair blower 11 of the type generally shown in U.S. Pat. No. 4,538,362, filed Oct. 31, 1983.

The blower comprises a housing formed by two members 13 and 21. One member or piece 13 is integrally formed to provide a handle portion or piece 15, an air inlet 17, and (see FIG. 5) a supporting annulus 19. The other piece or member 21 is formed to include a handle portion or piece 23, and a cylindrical or conical portion 25 which, at one end, adjacent the handle portion 23, includes (see FIG. 5 a supporting annulus 27 and which, at the other end, includes an air outlet 29.

Supported by the two annuli 19 and 27 is (see FIG. 5) a sleeve 31 which supports (see FIG. 5) an electrically operated motorized fan 33 and and an electrically operated heating device 35 (both shown schematically). Accordingly, when the fan 33 is energized, air is forced into the air inlet 17 and out of the air outlet 29, and when the heating device 35 is energized, such air is also heated.

Figure 6:
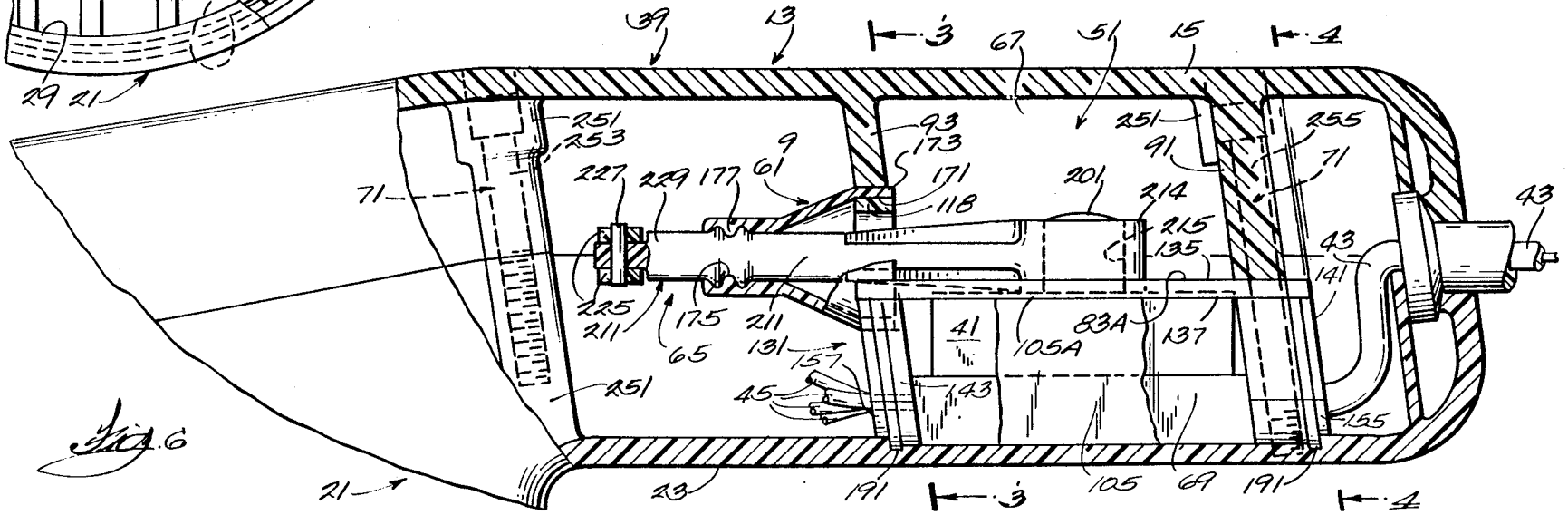
Fig. 6 is an enlarged sectional view taken at 90° to the view shown in FIG. 5 of the handle of the blower or dryer shown in FIG. 1.

The handle portions or pieces 15 and 23 form an elongated handle 39 which includes an electrical switch 41 connected to an electrical line which includes (See FIG. 5) two leads 43 leading to a suitable source of electrical energy (not shown) and to a circuit which includes (See FIG. 6) four leads 45 leading to the heating device 35 and the electrical fan 33. The handle pieces 13 and 21 have respective exterior surfaces 14 and 22 and respective mating edge surfaces 16 (see FIG. 8) and 24 (see FIG. 7) which respectively extend from the exterior surfaces 14 and 22 and (See FIGS. 3 and 4) which respectively mate with each other. One of the edge surfaces 16 and 24 includes therein a groove 18 and the other of the edge surfaces 16 and 24 includes therein a tongue 20 received in the groove 18. As thus far described, the construction is conventional.

In order, in effect, to waterproof the switch 41, while at the same time, avoiding complicated and expensive switch constructions, means are provided for forming, in the handle 39, (See FIGS. 5 and 6) a sealed waterproof cavity or chamber 51 for the electrical switch 41, which cavity or chamber 51 is of relatively economical construction. While various other arrangements can be employed, in the disclosed construction, the chamber 51 is provided (See FIG. 2) by use of suitable gasket means 61 which affords access for electrical leads 43 and 45 and for (See FIG. 5) a movable switch actuation means 65 and by forming the handle pieces 15 and 23 of water impervious and electrically insulating material (See FIG. 6) with respective blind recesses 67 and 69 having respective margins which register with the gasket means 61 and which are held in engagement with the gasket means 61 by fastening means 71 which tightly holds together the two handle pieces 15 and 23.

More particularly, the recess 67 in the handle piece 15 is provided by wall means formed (See FIGS. 3 and 4) by a portion 81 of the exterior wall of the handle piece 15 and by a pair of spaced and opposed interior side walls 83 and 85 which extend from opposite margins of the exterior wall portion 81 and inwardly of the respectively adjacent exterior wall portions 87 and 89 in spaced relation thereto. The recess 67 in the handle piece 15 is also defined, at one end, by a first transverse end wall 91 which extends between the interior side walls 83 and 85 and, at the other end, by a spaced second end wall 93 which extends between the interior side walls 81 and 83 and which includes therein a semi-circular notch 95.

The margin of the recess 67 formed by the side walls 83 and 85 and by the end walls 91 and 93 includes (see FIG. 8) an endless end surface 97 which is sealingly engaged by the gasket means 61.

The recess 69 in the handle piece 23 is similarly formed by wall means in the form of a portion 101 of the exterior wall of the handle piece 23 and by a pair of spaced and opposed interior side walls 103 and 105 which extend from the opposite sides of the exterior wall portion 101 and inwardly of the respectively adjacent portions 107 and 109 of the exterior wall and in spaced relation thereto. The recess 69 is further defined, at one end, by a transverse end wall 111 which extends between the sidewalls 103 and 105 and which has therein a U-shaped notch 113 and, at the other end, by a second end wall 115 which extends between the sidewalls 103 and 105 and which has therein a second U-shaped notch 117.

The margin of the recess 69 formed by the side walls 103 and 105 and by end walls 111 and 115 includes (see FIG. 7) an endless end surface 121 which is sealingly engaged by the gasket means 61.

Various gasket means 61 can be employed to engage the end surfaces 97 and 121 of the wall means and to close the ends of the recesses 67 and 69 to provide the moisture proof chamber 51. In the disclosed construction, as shown best in FIG. 2, the gasket means 61 is in the form of a gasket member 131 which is formed of resilient, rubber-like, electrically insulating material and which includes an endless portion 133 having opposed surfaces 135 and 137 which respectively sealingly engage the end surfaces 97 and 121 of the recesses 67 and 69.

More specifically, the surface 135 engages the end surface 97 along the edges 83A and 85A of the side walls 83 and 85, along the edge 91A of the end wall 91, and along the edge 93A of the end wall 93.

The surface 137 engages the end surface 121 along the edges 103A and 105A of the side walls 103 and 105, along the edge lllA of the end wall 111, and along the edge 115A of the end wall 115.

In addition, in the disclosed construction, the gasket member 131 also includes first and second end wall portions 141 and 143 which are spaced from each other in the direction of handle elongation, which extend integrally from the endless portion 133 and transversely of the direction of handle elongation, and which engage the end surfaces 97 and 121 of the notches 95, 113 and 117 in the end walls 93, 111, and 115.

More specifically, the end wall portion 141 engages the end surface 121 on the u-shaped notch 113 in the end wall 111, and the end wall portion 143 engages the end surface 97 on the semi-cylindrical notch 95 in the end wall 93 and the end surface 121 on the U-shaped notch 117 in the end wall 115.

The end wall portions 141 and 143 are respectively formed with respective main portions 151 and 153 and with respective end portions 155 and 157, which portions 151, 153, 155 and 157 have mating edges with semi-circular notches 159 to afford Passage into the sealed chamber 51 of electrical leads. While other arrangements are possible, in the disclosed construction, the two leads 43 pass through the end wall portion 141 of the gasket member 131 and the four leads 45 pass through the end wall portion 143 of the gasket member 131. It is preferred that adhesive be applied to the mating surfaces of the main portions 151 and 153 and to end portions 155 and 157 of the end wall portions 141 and 143 and around the electrical leads 43 and 45 to assure prevention of entry of moisture into the sealed cavity or chamber 51.

The gasket member 131 further includes, in the end wall portion 143 (See FIG. 6), a central opening 171 through which suitable switch actuation means 65 extends. Still further, in addition, the gasket member 131 includes a flexible and hollow bellows portion 173 which integrally extends from the end wall portion 143 in the direction of handle elongation and from around the margin of the opening 171. The hollow bellows portion 173 is sufficiently flexible to afford or permit movement thereof in the direction of handle elongation relative to the end wall portion 143.

In order to support the end of the bellows portion extending from the end wall portion, a supporting sleeve or washer 118 is preferably press fitted within the opening 171.

In addition, and in order to prevent entry of water between the bellows portion 173 and the actuation means 65, the bellows portion 173 and the actuation means 65 respectively include cooperating means in sealing engagement. While various constructions can be employed, in the disclosed construction, such means comprises (See FIGS. 5 and 6) an annular groove 175 on the actuation means and an annular bead 177 which is located adjacent the end of the bellows portion 173 and which is sealingly received in the annular groove 175. Accordingly, the flexibility of the bellows portion 173 facilitates movement of the actuation means 65 relative to the sealed chamber 51 in the direction of handle elongation while, at the same time, preventing entry of moisture.

Means are provided for locating the gasket member 131 relative to the handle piece 23 during assembly. While other arrangements are possible, in the disclosed construction, such means comprises slots 191 respectively formed in the end surface 121 of the recess end walls 111 and 115, and fins or ribs 193 extending integrally from the edges of the end wall portions 141 and 143 of the gasket member 131 and received in the slots 191, thereby serving both to locate the gasket member 131 in relation to the handle piece 23 and to further insure water tight integrity of the chamber 51.

Any suitable and inexpensive switch 41 can be employed. In the disclosed construction, the switch 41 is a three position switch having a switch button 201 movable between a first or "off" position, a second position energizing the blower or fan 33 without energizing the heating device 35, and a third position additionally energizing the heating device 35. The switch 41 is located in the waterproof chamber 51 so that the switch button 201 moves between its three positions in the direction of handle elongation. Any suitable means can be employed for locating the switch 41 within the sealed chamber 51. In the disclosed construction, suitable bosses 203 are provided for suitably engaging the exterior of the switch 41 to centrally locate the switch 41 in the sealed chamber or cavity 51.

Means are provided for operably connecting the switch button 201 to the actuation means 65 to effect switch operation in response to actuation by an operator. While various arrangements can be employed, in the disclosed construction, the actuation means 65 includes an interior actuator or plunger 211 which extends through the bellows, portion 173, which includes the before mentioned annual groove 175, and which, at the end within the waterproof chamber 51, includes an end portion 214 with a rectangular opening 215 which receives the switch button 201 so that the switch button 201 moves in the direction of handle elongation in response to movement of the interior actuator 211 to displace the switch button 201 between its three positions.

The actuation means 65 also includes an exterior actuator or slide 221 which is slidably mounted for movement in the direction of handle elongation by suitable guide means formed in conventional fashion adjacent the mating surfaces of the handle pieces 15 and 23.

Means are provided for operably connecting the interior and exterior actuators 211 and 221 for common movement. While other arrangements can be employed, in the disclosed construction, the exterior actuator or slide 221 includes a main portion 224 which slideably extends in a suitable elongated guideway 226 in the handle 39, an arm 225 which extends from the main portion 224 and inwardly of the handle 39 and which, at its inner end, frictionally grips a transverse rod or pin 227 on an end 229 of the interior actuator 211, which end 229 is located exteriorly of the bellows portion 173 of the gasket member 131. In addition, the slide 221 includes a knob 228 which extends through an opening 230 in the handle 39 and which is accessible by an operator. Accordingly, manual movement of the exterior actuator or slide 221 in the direction of handle elongation causes similar movement of the interior actuator or plunger 211 which, in turn, displaces the switch button 201 between its three positions.

As already mentioned, means are provided for fastening together the handle pieces 15 and 23 to press or clamp the gasket member 131 in Place between the handle pieces 15 and 23 and to thereby form the sealed chamber 51 which prevents water from reaching the switch 41.

While various other arrangements can be employed, in the disclosed construction, each of the handle pieces 15 and 23 includes, on opposites sides of, and in spaced relation to, the sealed chamber 51, an inwardly extending boss 251. The bosses 251 on one of the handle pieces, preferably the handle piece 15 are apertured to permit free passage therein of a pair self tapping screws 253 and 255 which are threaded into the bosses 251 in the other handle piece 23 to locate the handle pieces 15 and 23 in tightly adjacent relation to each other and so as to press or clamp the gasket member 131 between the end surfaces 97 and 121 of the wall means and thereby to seal the switch chamber 51.

While the screw 255 could be located to the right of (as shown in FIGS. 7 and 8) and in spaced relation to the end walls 91 and 111, in the disclosed construction, the end walls 91 and 111 are thickened in the direction of handle elongation and the end wall 91 is apertured to permit passage therethrough of the screw 255. It is also noted that the screw passes through an opening 291 in the gasket member 131 so that the watertight condition of the switch chamber 51 is maintained.

Various of the features of the invention are set forth in the following claims:

We claim:

1. A hand held electrically operated appliance, such as a hair dryer, a hair clipper, a hair blower, a curling iron, or other similar device, said appliance comprising a handle including first and second handle pieces including respective wall means defining blind recesses located in opposing relation to each other, a resilient gasket disposed between said wall means to define, with said recesses, a waterproof switch chamber including therein an electrical switch, said gasket means including means affording water-tight passage into and from said chamber of an appropriate number of electrical leads, actuator means passing in water-tight relation through said gasket into said chamber, being operably connected to said switch, and being manually movable by an operator so that movement of said actuator means causes related movement of said switch between off and on positions, and means for fastening together said handle pieces to press said gasket between said wall means to prevent entry of moisture into said chamber.

2. An appliance in accordance with claim 1 wherein said handle pieces have respective exterior surfaces and respective mating edge surfaces which respectively extend from said exterior surfaces and which respectively mate with each other, and wherein said recess defining wall means are located in spaced relation from and inwardly of said edge surfaces.

3. An appliance in accordance with claim 1 wherein said gasket includes an endless portion with opposed surfaces respectively engaging said recess defining wall means of said handle pieces.

4. An appliance in accordance with claim 3 wherein said recesses have respective end walls, and wherein said gasket includes spaced end wall portions extending transversely from said endless portion and engaging said end walls of said recesses.

5. An appliance in accordance with claim 4 wherein one of said end wall portions includes a main portion and an end portion, and wherein electric leads pass through said end wall portion between said main portion and said end portion.

6. An appliance in accordance with claim 5 wherein said gasket further includes a hollow bellows communicating with said chamber and movable relative to said chamber, and through which said actuator means extends, and wherein said bellows and said actuator means include means for sealing engagement therebetween.

7. A hand held electrically operated appliance, such as a hair dryer, a hair clipper, a hair blower, or other similar device, said appliance comprising an elongated handle including first and second handle pieces constructed of water impervious and electrically insulating material and including respective first and second wall means defining blind recesses located in opposing and aligned relation to each other and having respective margins with respective end surfaces, a resilient gasket disposed between said first and second wall means and engaging said end surfaces to define, with said recesses, a waterproof switch chamber, said gasket including means affording water-tight passage into and from said chamber of an appropriate number electrical leads, an electrical switch located in said chamber and connected to said electrical leads, an interior switch actuator located interiorly of said handle and passing in water-tight relation through said gasket into said switch chamber and being movable in the direction of handle elongation, said interior switch actuator being operably connected to said switch, and an exterior actuator movably carried by said handle in spaced relation to said chamber and for movement in the direction of handle elongation, said exterior acutator being manually movable by an operator and being operably connected to said interior actuator so that movement of said exterior actuator causes related movement of said interior actuator to actuate said switch between off and on positons, and means for fastening together said handle pieces to press said gasket means between said first and second wall means to prevent entry of moisture into said chamber.

8. An appliance in accordance with claim 7 wherein said handle pieces have respective exterior surfaces and respective mating edge surfaces which respectively extend from said exterior surfaces and which respectively mate with each other, and wherein said end surfaces of said recess defining wall means are located in spaced relation from and inwardly of said edge surfaces.

9. An appliance in accordance with claim 8 wherein said edge surface of one of said handle pieces includes therein a groove and wherein said edge surface of the other of said handle pieces includes therein a tongue received in said groove.

10. An appliance in accordance with claim 7 wherein said gasket includes an endless portion with opposed surfaces respectively engaging said end surfaces of said handle pieces.

11. An appliance in accordance with claim 10 wherein said recesses have respective end walls, and wherein said gasket includes spaced end wall portions extending transversely from said endless portion and engaging said end walls of said recesses.

12. An appliance in accordance with claim 11 wherein one of said end wall portions includes a main portion, and an end portion, and wherein electric leads pass through said end wall portion between said main portion and said end portion.

13. An appliance in accordance with claim 11 wherein one of said end wall portions includes therein a central opening through which said interior actuator extends, and wherein said gasket further includes a hollow bellows portion extending from said one end wall portion and movable relative to said one end wall portion in the direction of handle elongation, and through which said interior actuator extends, and wherein said bellows portion and said interior actuator include means for sealing engagement therebetween.

14. A hand held electrically operated appliance, such as a hair dryer, a hair clipper, a hair blower, or other similar device, said appliance comprising an elongated handle including first and second handle pieces constructed of water impervious and electrically insulating material and including respective exterior surfaces, respective mating edge surfaces which respectively extend from said exterior surfaces and which respectively mate with each other, and respective first and second wall means defining blind recesses located in opposing and aligned relation to each other and having respective interior surfaces having respective margins with respective end surfaces located in spaced relation from and inwardly of said edge surfaces, a resilient gasket disposed between said first and second wall means and engaging said end surfaces to define, with said recesses, a waterproof switch chamber, said gasket including an endless portion with opposed surfaces respectively engaging said end surfaces of said handle pieces, spaced end wall portions extending transversely from said endless portion and engaging said end surfaces of said handle pieces, one of said end wall portions including a main portion and an end portion, and one of said end wall portions including a central opening, and an integrally extending hollow bellows portions movable relative thereto in the direction of handle elongation, an electrical switch in said chamber, eletrical leads extending into said chamber between said main portion and said end portion of said one end wall and connected to said switch, an interior switch actuator located interiorly of said handle and passing in water-tight relation through said bellows portion of said gasket member into said switch chamber and being movable in the direction of handle elongation, said interior switch actuator being operably connected to said switch, an exterior actuator movably carried by said handle in spaced relation to said chamber and for movement in the direction of handle elongation, said exterior actuator being manually movable by an operator and being operably connected to said interior actuator so that movement of said exterior actuator causes related movement of said interior actuator to actuate said switch between off and on positions, means on said bellows portion and said interior actuator for sealing engagement therebetween, and means for fastening together said handle pieces to press said gasket member between said first and second wall means to prevent entry of moisture into said chamber.

15. A hand held electrically operated appliance, such as a hair dryer, a hair clipper, a hair blower, a curling iron, or other similar device, said appliance comprising an elongated handle including first and second handle pieces including respective wall means defining blind recesses located in opposing relation to each other, a resilient gasket disposed between said wall means to define, with said recesses, a waterproof switch chamber including therein an electrical switch, actuator means operably connected to said switch, and manually movable by an operator so that movement of said actuator means causes related movement of said switch between off and on positions, said actuator means including a member movable lengthwise of said handle and passing in water-tight relation through said gasket into said chamber, and means for fastening together said handle pieces to press said gasket between said wall means to prevent entry of moisture into said chamber.

16. An appliance in accordance with claim 15 wherein said handle pieces have respective exterior surfaces and respective mating edge surfaces which respectively extend from said exterior surfaces and which respectively mate with each other, and wherein said recess defining wall means are located in spaced relation from and inwardly of said edge surfaces.

17. An appliance in accordance with claim 15 wherein said gasket includes an endless portion with opposed surfaces respectively engaging said recess defining wall means of said handle pieces.

18. An appliance in accordance with claim 17 wherein said recesses have respective end walls, and wherein said gasket includes spaced end wall portions extending transversely from said endless portion and engaging said end walls of said recesses.

19. An appliance in accordance with claim 18 wherein one of said end wall portions includes a main portion and an end portion, and wherein electric leads pass through said end wall portion between said main portion and said end portion.

20. An appliance in accordance with claim 19 wherein said gasket further includes a hollow bellows communicating with said chamber and movable relative to said chamber, and through which said actuator means extends, and wherein said bellows and said actuator means include means for sealing engagement therebetween.

* * * * *

UNITED STATES PATENT AND TRADEMARK OFFICE

CERTIFICATE OF CORRECTION

PATENT NO. : 4,742,199

DATED : May 3, 1988

INVENTOR(S) : Andis, et al.

It is certified that error appears in the above–identified patent and that said Letters Patent are hereby corrected as shown below:

On the cover page, Item ]73]

Assignee: ANDIS COMPANY
Racine, Wisconsin

Signed and Sealed this

Ninth Day of April, 1996

*Attest:*

*Attesting Officer*

BRUCE LEHMAN

*Commissioner of Patents and Trademarks*